US005875886A

United States Patent [19]

Elster

[11] Patent Number: 5,875,886

[45] Date of Patent: Mar. 2, 1999

[54] LIGHT SWITCH EXTENSION

[75] Inventor: Simon L. Elster, Montreal, Canada

[73] Assignee: Illumination S.L.E. Inc., Montreal, Canada

[21] Appl. No.: 982,548

[22] Filed: Dec. 2, 1997

[30] Foreign Application Priority Data

Jun. 26, 1997 [CA] Canada ..... 2209814

[51] Int. Cl.[6] ..... H01H 3/02

[52] U.S. Cl. ..... 200/331

[58] Field of Search ..... 74/543, 544; 200/17 R, 200/38 R, 52 R, 330, 331

[56] References Cited

U.S. PATENT DOCUMENTS

| | | | |
|---|---|---|---|
| 275,042 | 4/1883 | Heysinger . | |
| 1,175,838 | 3/1916 | Sutter . | |
| 1,572,695 | 2/1926 | Van Amburg et al. . | |
| 1,721,222 | 7/1929 | Kaminsky . | |
| 2,146,146 | 2/1939 | Innis | 200/168 |
| 2,211,818 | 8/1940 | Innis | 200/168 |
| 2,354,224 | 7/1944 | Stein | 200/168 |
| 2,389,220 | 11/1945 | Tredeau | 200/172 |
| 2,461,614 | 2/1949 | Seaman | 200/172 |
| 2,466,820 | 4/1949 | Oberschmidt | 200/172 |
| 2,493,581 | 1/1950 | Hood | 200/172 |
| 2,580,905 | 1/1952 | Foster | 200/172 |
| 2,668,456 | 2/1954 | Meistrell | 74/503 |
| 2,692,932 | 10/1954 | Parke et al. | 200/172 |
| 2,719,898 | 10/1955 | Allen | 200/172 |
| 2,724,032 | 11/1955 | Coletta | 200/172 |
| 2,726,303 | 12/1955 | Berndsen | 200/172 |
| 2,760,035 | 8/1956 | Friesen | 200/172 |
| 2,775,674 | 12/1956 | Meder | 200/172 |
| 2,919,334 | 12/1959 | Jones | 200/172 |
| 3,004,128 | 10/1961 | Mikolajeski | 200/172 |
| 3,077,789 | 2/1963 | De Lashmutt | 74/503 |
| 3,121,778 | 2/1964 | Sander et al. | 200/172 |
| 3,142,744 | 7/1964 | Keck | 200/172 |
| 3,175,420 | 3/1965 | Craig | 74/544 |
| 3,188,439 | 6/1965 | Fullerton | 200/172 |
| 3,311,716 | 3/1967 | Carlson | 200/6 |
| 3,339,051 | 8/1967 | De Vall | 200/172 |
| 3,581,037 | 5/1971 | Schiffelbein | 200/172 A |
| 3,590,648 | 7/1971 | Gorman | 74/103 |
| 3,617,676 | 11/1971 | Dennison | 200/172 A |
| 3,722,319 | 3/1973 | Reznik et al. | 74/544 |
| 3,825,710 | 7/1974 | Roberts et al. | 200/172 A |
| 3,827,039 | 7/1974 | Agnese | 340/227.1 |
| 3,839,615 | 10/1974 | Bradford | 200/331 |
| 3,892,935 | 7/1975 | Patterson | 200/331 |
| 3,916,134 | 10/1975 | Hansen | 200/331 |
| 3,939,725 | 2/1976 | Fisher | 74/503 |

(List continued on next page.)

FOREIGN PATENT DOCUMENTS

| | | | |
|---|---|---|---|
| 1114866 | 12/1984 | Canada | H01H 3/02 |
| 1185304 | 4/1985 | Canada | H01H 3/02 |
| 1242236 | 9/1988 | Canada | H01H 27/00 |
| 2150758 | 12/1996 | Canada | F16M 13/00 |

*Primary Examiner*—Michael A. Friedhofer
*Attorney, Agent, or Firm*—Collard & Roe, P.C.

[57] ABSTRACT

A switch extension device for actuating a switch having an actuator projecting from a fascia plate. The actuator has upward and downward positions corresponding to "on" and "off" positions of the actuating member. The switch extension device has a front cover plate where the back surface includes grooves for receiving in slidable relationship a slider device. The front cover plate is secured to the fascia plate. The slider device has lower and upper parts, the upper part being slidably mounted on the back surface of the front cover plate in the grooves and the lower part of the slider device protruding downwardly from the front cover plate. The slider device may be adapted to actuate a flat rocker-type switch or a conventional toggle switch. The lower part of the switch extension device further has an extension strip of an appropriate length to extend downwardly the possibility of actuating the switch. In an embodiment, the extension strip is pivotably connected to the lower part of the slider device. The switch extension device is easy to install and provides for smooth movement.

17 Claims, 6 Drawing Sheets

U.S. PATENT DOCUMENTS

| | | | |
|---|---|---|---|
| 4,105,884 | 8/1978 | Damsky | 200/331 |
| 4,221,946 | 9/1980 | Halstrum | 200/331 |
| 4,256,943 | 3/1981 | Whitlock | 200/331 |
| 4,295,026 | 10/1981 | Williams et al. | 200/331 |
| 4,296,291 | 10/1981 | Johnson | 200/331 |
| 4,419,556 | 12/1983 | Hare | 200/331 |
| 4,454,401 | 6/1984 | Powis, Jr. | 200/331 |
| 4,562,325 | 12/1985 | De Rouen | 200/331 |
| 4,567,337 | 1/1986 | Woods et al. | 200/331 |
| 4,590,345 | 5/1986 | Marshell | 200/331 |
| 4,705,924 | 11/1987 | Hevoyan | 200/331 |
| 4,743,724 | 5/1988 | Goodwin, Jr. et al. | 200/331 |
| 4,771,145 | 9/1988 | Davis, Jr. | 200/331 |
| 4,870,232 | 9/1989 | Hoogland | 200/331 |
| 4,899,050 | 2/1990 | Cianflone | 200/331 |
| 4,914,265 | 4/1990 | Mongeau | 200/330 |
| 5,017,746 | 5/1991 | Guimarin | 200/331 |
| 5,046,143 | 9/1991 | Uher | 200/331 |
| 5,055,645 | 10/1991 | Hull et al. | 200/331 |
| 5,066,840 | 11/1991 | Wiktor et al. | 200/330 |
| 5,124,513 | 6/1992 | Blair | 200/331 |
| 5,374,797 | 12/1994 | McMillan | 200/331 |
| 5,380,967 | 1/1995 | Steen et al. | 200/331 |
| 5,393,946 | 2/1995 | Delahoz | 200/331 |
| 5,396,037 | 3/1995 | Moore et al. | 200/331 |
| 5,451,734 | 9/1995 | Price | 200/331 |
| 5,498,845 | 3/1996 | Browning | 200/331 |
| 5,577,602 | 11/1996 | Conner et al. | 200/331 |
| 5,590,759 | 1/1997 | Hawkins et al. | 200/331 |

LIGHT SWITCH EXTENSION

FIELD OF THE INVENTION

The present invention relates to a switch extension device for electrical wall light switches.

DESCRIPTION OF THE PRIOR ART

Two main types of switches are presently used in homes, offices, hospitals, or other places to activate electrical appliances such as interior lights. The most common of these switches is the toggle-type switch, but another popular type is the flat rocker-type switch sold under the trade-mark DECORA among other brands. The function of these switches is essentially to provide ON and OFF positions and consequently to turn on or turn off the appliances so controlled.

These switches are usually mounted on a vertical wall at a standard height of approximately four and a half feet above the floor. This location of the switches make them inconvenient for small children who may not be able to reach the switch, or for people who have disabilities and are confined to a wheelchair, or for people who have a height shorter than the average height of a person.

Accordingly, a number of devices have been proposed to "extend" the actuation of these switches down to a level which is more accessible for children or people who are confined to a wheelchair. These devices usually include some sort of extension rod which extends downwardly from the switch and operatively connected thereto.

As an example of these devices, the following patents may be of interest: U.S. Pat. Nos. 5,380,967; 5,374,797; 3,825,710; 3,188,439; 3,077,789; 3,004,128; 2,775,674; 2,724,032 and 2,493,581.

However, although these devices purport to provide improvements in these devices such as ease of installation and simplicity in construction, it has been found that, to Applicant's knowledge, few of these have been actively commercialized and those that have been commercialized have the disadvantage of not providing smooth movement. It has also been found that some of these devices are not easy to install. Furthermore, these devices are not easily adaptable to different types of switches.

SUMMARY OF THE INVENTION

Accordingly, it is an object of the invention to provide a switch extension device for a wall mounted switch, such as a toggle-type switch or a flat rocker-type switch, which can be easily installed and which provides smooth movement for the actuation of the switch.

In accordance with the invention, this object is achieved with a switch extension device for actuating a switch having an actuating member projecting from a fascia plate. The actuating member has upward and downward positions corresponding to "on" and "off" positions of the actuating member. The switch extension device has a front cover plate having a front surface, a back surface, an upper end and a lower end, where the back surface includes holding means for receiving in slidable relationship a slider device. Attaching means are provided for securing the front cover plate to the fascia plate. The slider device has lower and upper parts, the upper part being slidably mounted on the back surface of the front cover plate in the holding means and the lower part of the slider device protruding downwardly from the front cover plate.

In a first preferred embodiment of the invention, the slider device is adapted for use with a flat rocker-type switch having a pivotable actuating member including upper and lower rocker portions in longitudinal planar relationship to each other, each rocker portion pivoting between upward and downward positions corresponding to the "on" and "off" positions. The slider device has a first knob at its upper part, the first knob projecting towards the actuating member and including biasing means for constantly exerting pressure on the pivotable actuating member of the flat rocker-type switch. The first knob slides between up and down positions so that when the knob is at the up position, pressure is exerted on the upper rocker portion and, alternatively, when the knob is at the down position, pressure is exerted on the lower rocker portion so as to actuate the actuating member between the "on" and "off" position through the sliding of the slider member.

In a second preferred embodiment of the invention, the slider device is adapted for use with a conventional toggle switch having an actuating member pivoting between upward and downward positions corresponding to "on" and "off" positions of the actuating member. The upper part of the slider device has an opening shaped and sized to engage the actuating member, the slider device sliding between up and down positions so that when the slider device is at the up position, the opening toggles the actuating member to the "on" position, and, alternatively, when the slider device is at the down position, the opening toggles the actuating member to the "off" position.

Preferably, in each of the embodiments, the lower part of the slider device is further provided with an extension strip, which can be pivotably secured to the lower part of the slider device.

The switch extension device according to the invention is easy to install on an existing switch and does not require the intervention of an electrician.

BRIEF DESCRIPTION OF THE DRAWINGS

The present invention and its advantages will be more easily understood after reading the following non-restrictive description of preferred embodiments thereof, made with reference to the following drawings in which.

DESCRIPTION OF PREFERRED EMBODIMENTS OF THE INVENTION

Figure 1:
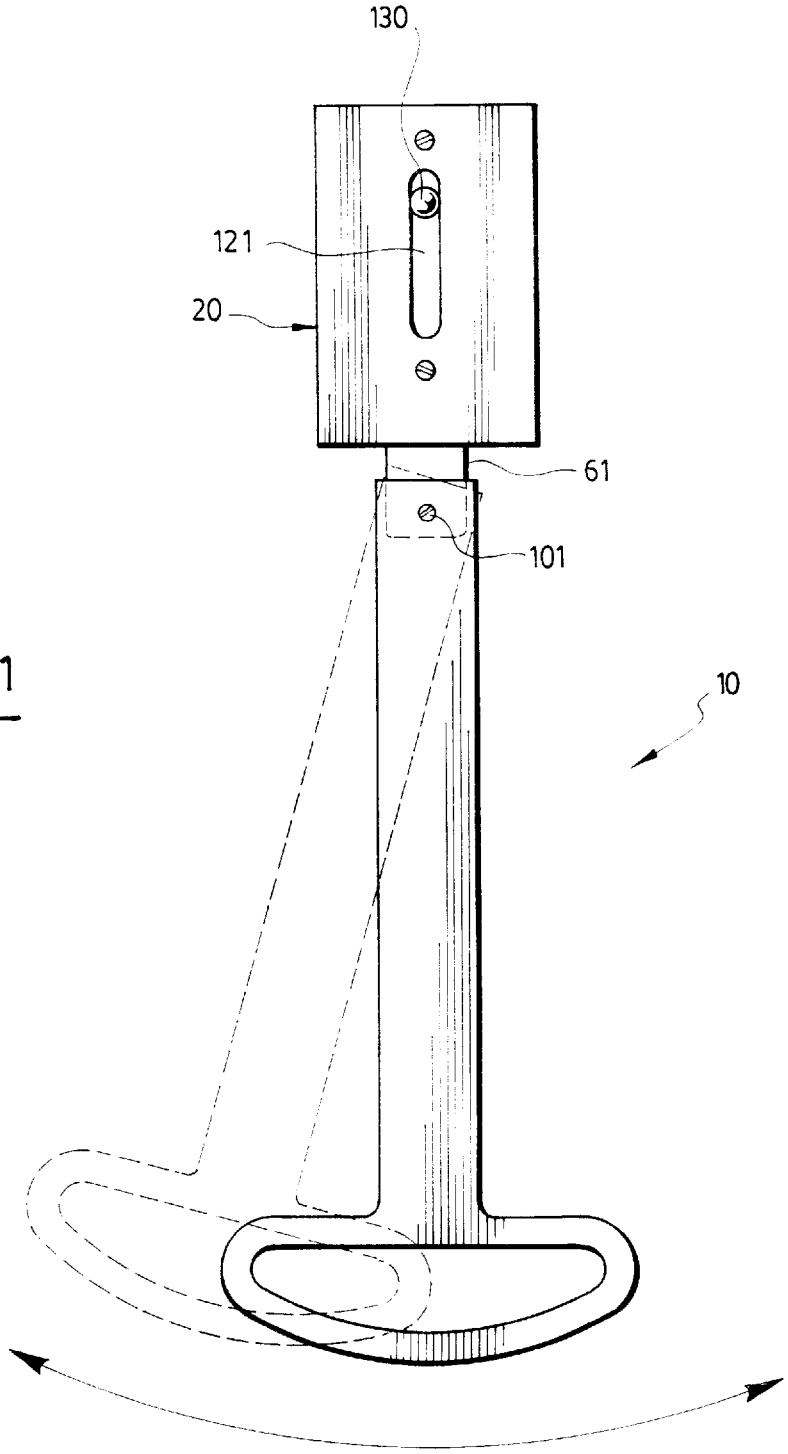
FIG. 1 is a front view of a switch extension device according to the invention, showing the pivotable extension strip.
Figure 2:
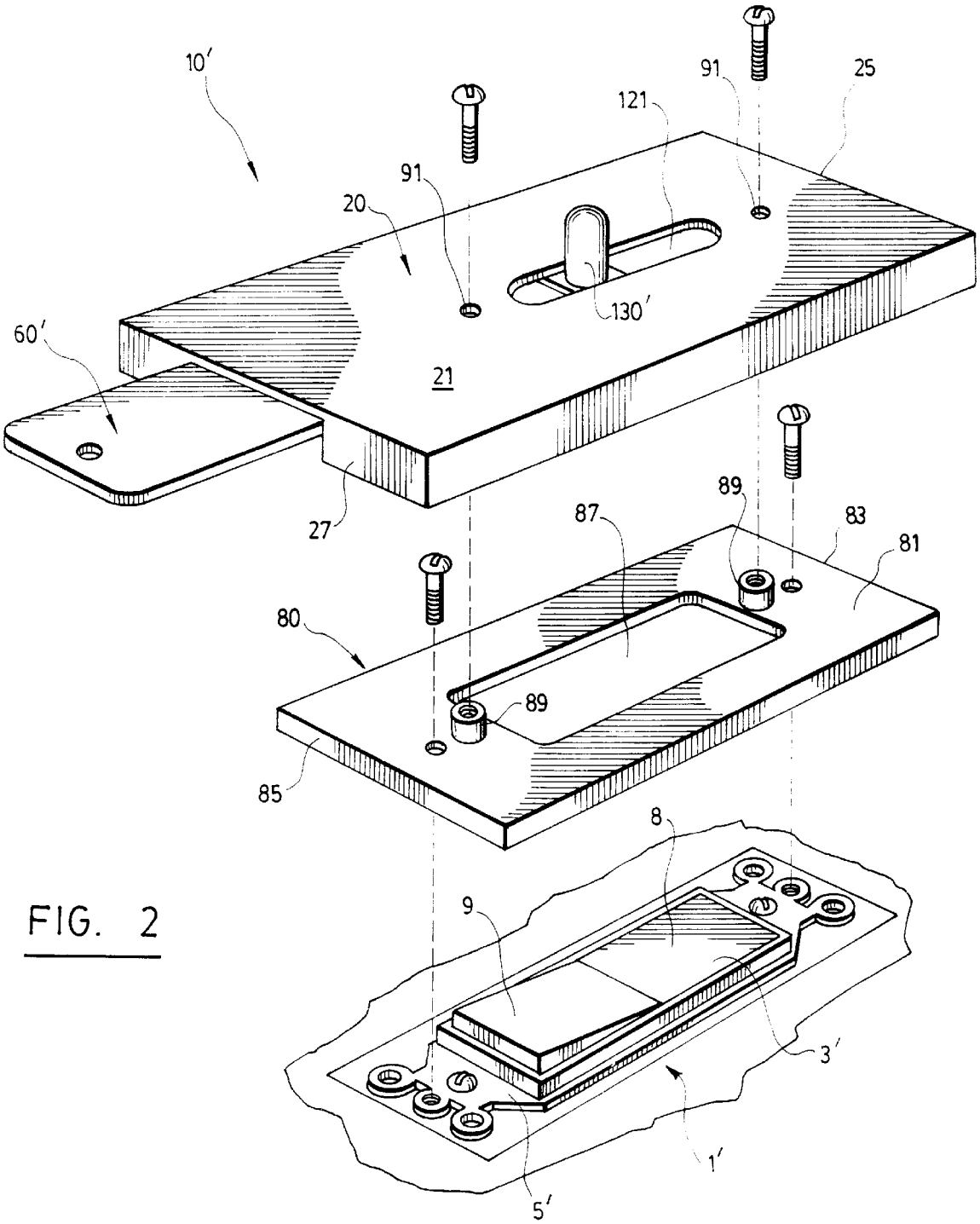
FIG. 2 is an exploded view of the switch extension device according to a first preferred embodiment of the invention.

As mentioned previously, the invention relates to a switch extension device 10 for a switch 1. It should be understood that although flat rocker-type switches and conventional toggle switches are shown, minor modifications may be made to the invention to adapt it to a sliding switch, or to a switch made up of two independent actuators, such as the ones used to actuate fluorescent lights.

Furthermore, each of the two preferred embodiments of the invention will be discussed separately, but it should be understood that the invention has, as its main purpose, the provision of a switch extension device 10 for actuating a switch 1 having an actuating member 3 projecting from a fascia plate 5. The actuating member 3 has upward and downward positions corresponding to "on" and "off" positions of the actuating member 3. It should also be understood that the terms "on" and "off" are used for convenience only, since it is possible that, due to wiring, when the actuating member 3 is at the upward position, it may actually turn off the current, whereas when the actuating member 3 is at the downward position, it turns on the current. It should further be understood that the switch 1 referred to can actuate not only lights, but also any other type of electrical appliance. The only requirement under the invention is that the switch 1 be wall-mounted, and at a distance from the floor which make it inconvenient for some people to actuate.

The switch extension device 10 has a front cover plate 20 having a front surface 21, a back surface 23, an upper end 25 and a lower end 27, where the back surface 23 includes holding means 40 for receiving in slidable relationship a slider device 60. Attaching means 80 are provided for securing the front cover plate 20 to the fascia plate 5. The slider device 60 has lower 61 and upper 63 parts, the upper part 63 being slidably mounted on the back surface 23 of the front cover plate 20 in the holding means 40 and the lower part 61 of the slider device 60 protruding downwardly from the front cover plate 20.

It should also be understood that the only component which needs to be modified in order to adapt the switch extension device 10 to one switch or another is the slider device 60.

Accordingly, identical parts in the various embodiments of the invention will be identified by identical reference numerals, but variations on a part will be identified by a primed reference numeral, or a double-primed referenced numeral, as the case may be. For the purposes of simplicity, the parts dealing with the first preferred embodiment of the invention will be primed, i.e. 0', and the parts dealing with the second preferred embodiment of the invention will be double primed, i.e. 0".

1. Flat rocker-type switch

In a first preferred embodiment of the invention, the switch extension device 10' is adapted for use with a flat rocker-type switch 1'. A flat rocker-type switch 1', referred to above as being sold under the trade-mark DECORA among other brands, has a pivotable actuating member 3' projecting from a fascia plate 5'. The actuating member 3' has upper 8' and lower 9' rocker portions in longitudinal planar relationship to each other, where each rocker portion 8', 9' pivots between upward and downward positions corresponding to the "on" and "off" positions of the actuating member 3.

The switch extension device 10', according to this first preferred embodiment of the invention, has a front cover plate 20 having a front surface 21, a back surface 23, an upper end 25 and a lower end 27. The back surface 23 includes holding means 40 for receiving in slidable relationship a slider device 60'.

Preferably, these holding means 40 include a set of longitudinal grooves 41 substantially parallel to each other.

Figure 3:
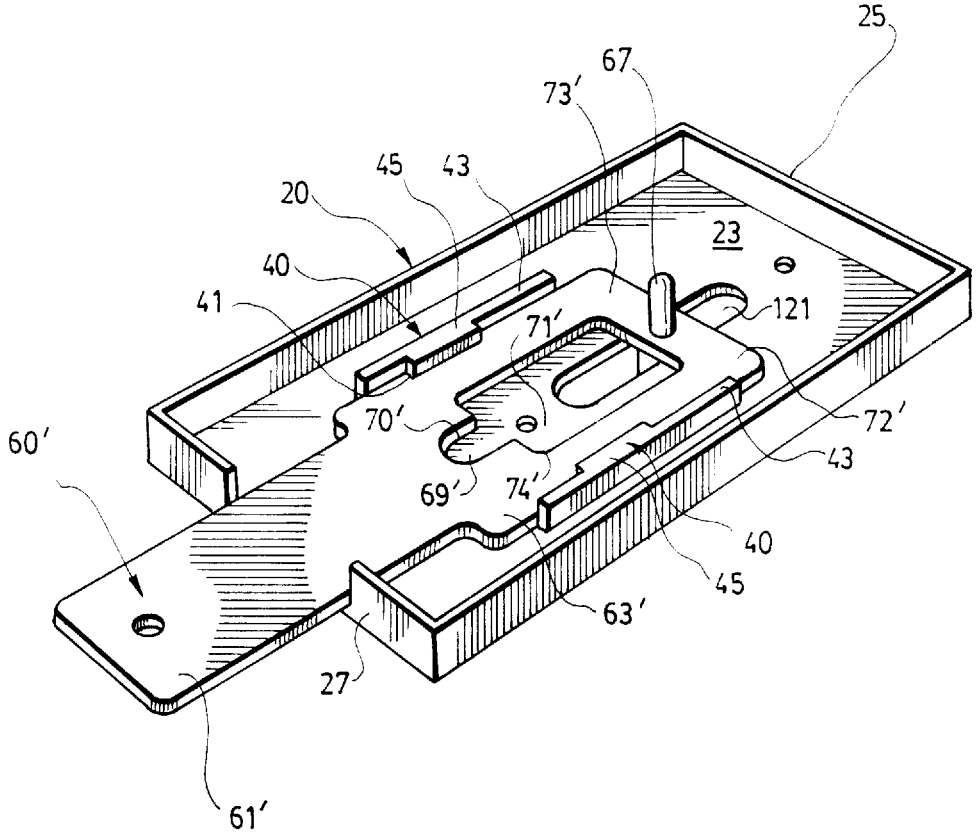
FIG. 3 is a rear perspective view of the front cover plate and the slider device of the embodiment shown on FIG. 2.

The slider device 60' has upper 63' and lower 61' parts, where the upper part 63' is slidably mounted on the back surface 23 of the front cover plate 20 in the holding means 40. The slider device 60' has two opposite sides 65' and each of the opposite sides 65' is preferably adapted to slide within one of the grooves 41. As is shown on FIG. 3, the grooves 41 are defined by two parallel flanges 43 projecting towards the switch 1', and each of the flanges 43 is provided with an inwardly projecting rib 45 on at least a portion of the flange 43.

The upper part 63' of the slider device 60' comprises a first knob 67' projecting towards the actuating member 3', and the first knob 67' includes biasing means 75' for constantly exerting pressure of the pivotable actuating member 3'.

Preferably, the biasing means 75' includes a spring 77', where the spring 77' forces the knob 67' against the pivoting actuating member 3'. However, the biasing means 75' could also be simply a projection on the upper part 63' of the slider device 60' projecting towards the actuating member 3', or any other type of mechanism which provides constant pressure on the actuating member 3'.

Figure 4:
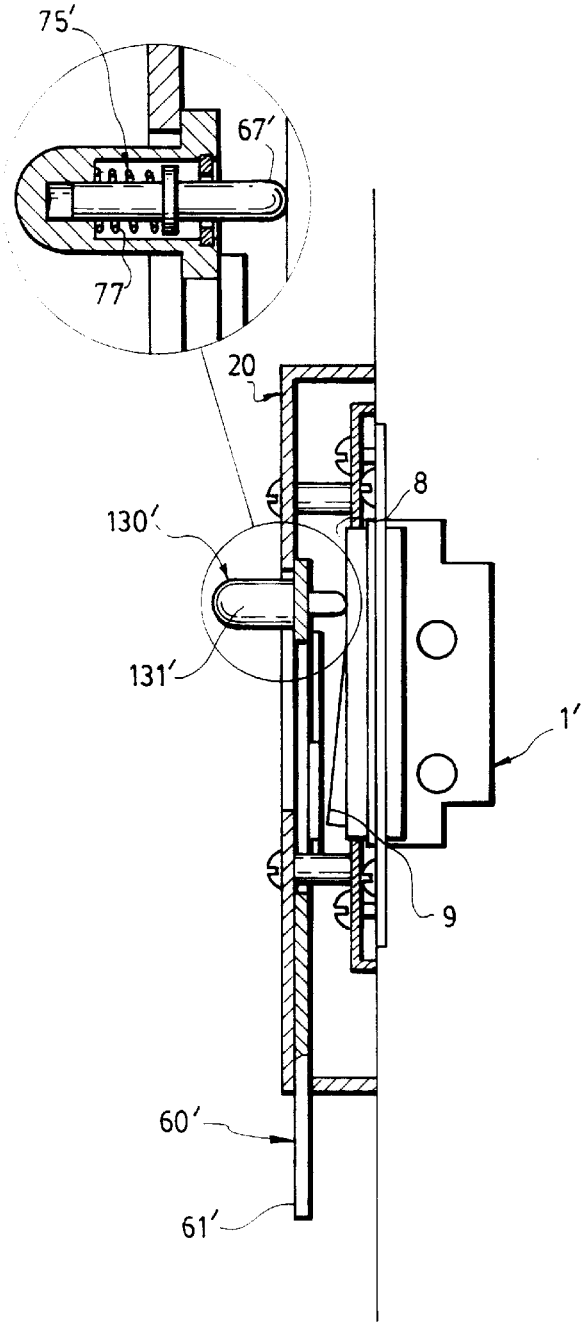
FIG. 4 is a cross-sectional view of the switch extension device shown on FIG. 2 in the "on" position.
Figure 5:
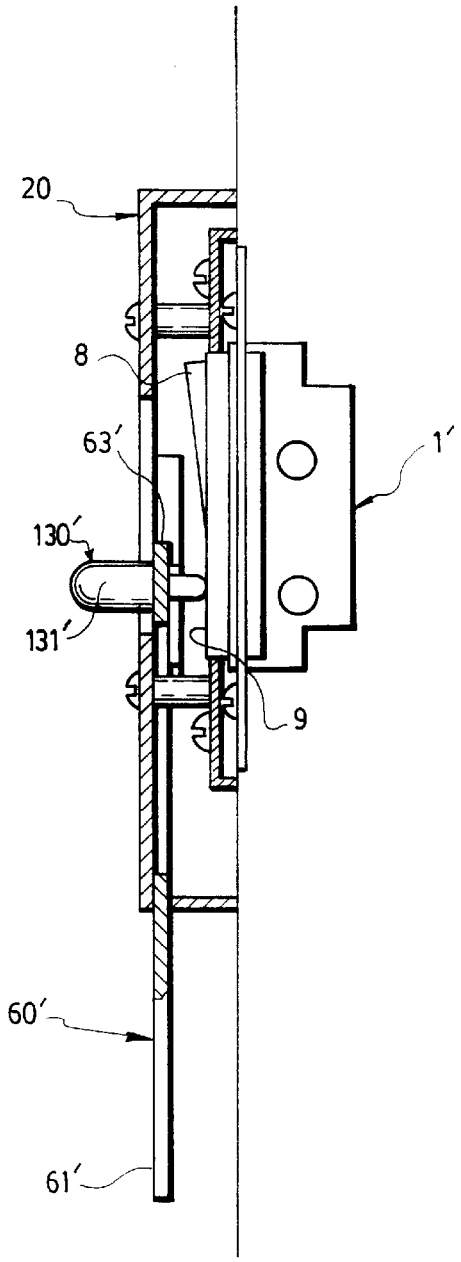
FIG. 5 is a cross-sectional view of the switch extension device shown on FIG. 3 in the "off" position.

In use, when the slider device 60', and consequently the first knob 67', is slid at the upward position, the first knob 67' exerts pressure on the upper rocker portion 8', corresponding to the "on" position (see FIG. 4), and, alternatively, when the slider device 60' is slid at the downward position, the first knob 67' exerts pressure on the lower rocker portion 9', corresponding to the "off" position (see FIG. 5). Thus, by sliding the slider device 60' up and down, actuation and deactuation of the switch 1' is effected.

The lower part 61' of the slider device 60' protrudes downwardly from the front cover plate 20, as better shown on FIGS. 2, 3, 4 and 5. The lower part 61' of the slider device 60' may extend downwardly to the desired height above floor level, or may further include an extension strip 100 secured thereto. Preferably however, this extension strip 100 is pivotably secured to the lower part 61 of the slider device 60 as shown on FIG. 1, so that the extension strip 100 may pivot about a pivot point 101. This is particularly advantageous when the switch one wants extended is near, for example, a bed, so that a person lying in bed, simply by stretching an arm, may actuate the switch.

In order to actuate the switch 1' manually, i.e. at the height at which the switch 1' is located, the front cover plate 20 is advantageously provided with a longitudinal opening 121 for receiving manual actuating means 130'. The manual actuating means 130' include a second knob 131' fixed to the upper part 63' of the slider device 60' and projecting on the opposite direction from the first knob 67' through the longitudinal opening 121. As can be better seen on FIG. 4, the second knob 131' is hollow and houses the spring 77' which biases the first knob 67'. It should also be noted that the first knob 67' extends at least partly inside the second knob 131'.

The longitudinal opening 121 preferably has a length adapted to the distance to be travelled by the first knob 67' along the actuating member 3', so that the longitudinal opening 121 and the second knob 131' limit the sliding of the first knob 67' at the up and down positions.

Attaching means 80 are also provided for attaching the front cover plate 20 to the fascia plate 5'. Preferably, the attaching means 80 include a switch plate 81 having a top 83, a bottom 85 and an aperture 87 positioned and sized to receive the actuating member 3' of the flat rocker-type switch 1'. The switch plate 81 is screwed to the fascia plate 5'.

Figure 6:
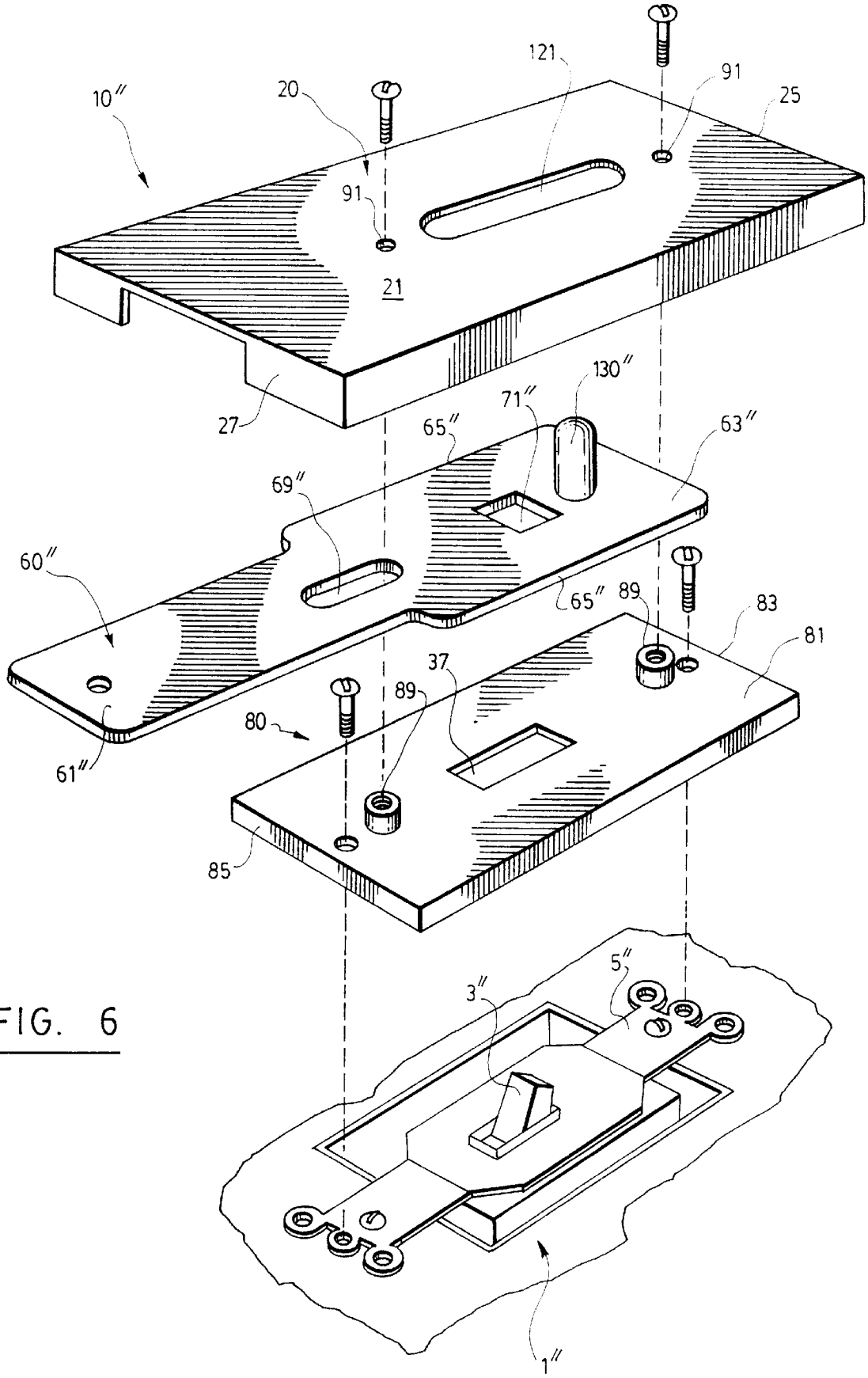
FIG. 6 is an exploded view of the switch extension device according to a second preferred embodiment of the invention.

Preferably, the switch plate 81 includes a protruding cylinder 89 at each of the top 83 and bottom 85 of the switch plate 81 (see FIG. 6, for example). Thus, the front cover plate 20 is provided with two holes 91 in registered positions with the protruding cylinders 89 of the switch plate and the front cover plate 20 is screwed to the switch plate 81 through these holes 91. In order for the slider device 60' to slide, it is further provided with means 69' for receiving the protruding cylinder 89 at the bottom 85 of the switch plate 81.

If the flat rocker-type switch 1' projects considerably when in the "on" position (much more than that shown on FIG. 4), then the slider device 60' may interfere with the first knob 67' in that the first knob 67' cannot push the upper rocker portion 8' enough to actuate the switch 1'. To that effect, the slider device 60' further includes an opening 71' having an upper end 73', a lower end 74' and a width at least equal to the width of the actuating member 3'. The opening defines a contour 72', and the first 67' and second 131' knob are located on the contour 72' proximate the upper end 73' of the opening 71'. Furthermore, the means 69' for receiving the lower protruding cylinder 89 may be the opening 71' in its totality (if the opening is long enough), or if the opening 71' is slightly shorter, the means 69' may include a longitudinal recess 70' provided at the lower end 74' of the opening 71'.

Thus, the switch extension device 10' may be easily installed on a flat rocker-type switch 1' easily. Furthermore, the device 10' according to this first preferred embodiment may permit actuation of the switch from a lower height or from the normal height at which the switch is installed.

2. Toggle switch

In a second preferred embodiment of the invention, the switch extension device 10" is adapted for use with a conventional toggle switch 1". A toggle switch 1" has an actuating member 3" projecting from a fascia plate 5". The actuating member 3" pivots between upward and downward positions corresponding to the "on" and "off" positions of the actuating member 3".

The switch extension device 10", according to this first preferred embodiment of the invention, has a front cover plate 20 having a front surface 21, a back surface 23, an upper end 25 and a lower end 27. The back surface 23 includes holding means 40 for receiving in slidable relationship a slider device 60".

Preferably, these holding means 40 include a set of longitudinal grooves 41 substantially parallel to each other.

The slider device 60" has upper 63" and lower parts 61", where the upper part 63" is slidably mounted on the back surface 23 of the front cover plate 20 in the holding means 40. The slider device 60" has two opposite sides 65" and each of the opposite sides 65" is preferably adapted to slide within one of the grooves 41. As is shown on FIG. 3, keeping in mind that the front cover plate 20 is identical for both embodiments of the invention, the grooves 41 are defined by two parallel flanges 43 projecting towards the switch 1", and each of the flanges 43 is provided with an inwardly projecting rib 45 on at least a portion of the flange 43.

The upper part 63" of the slider device 60" comprises an opening 71" shaped and sized to engage the actuating member 3".

In use, when the slider device 60" is slid at the upward position, the opening 71" toggles the actuating member 3" to the "on" position, and, alternatively, when the slider device 60" is slid at the downward position, the opening 71" toggles the actuating member 3" to the "off" position. Thus, by sliding the slider device 60" up and down, actuation and deactuation of the toggle switch 1" is effected.

Figure 7:
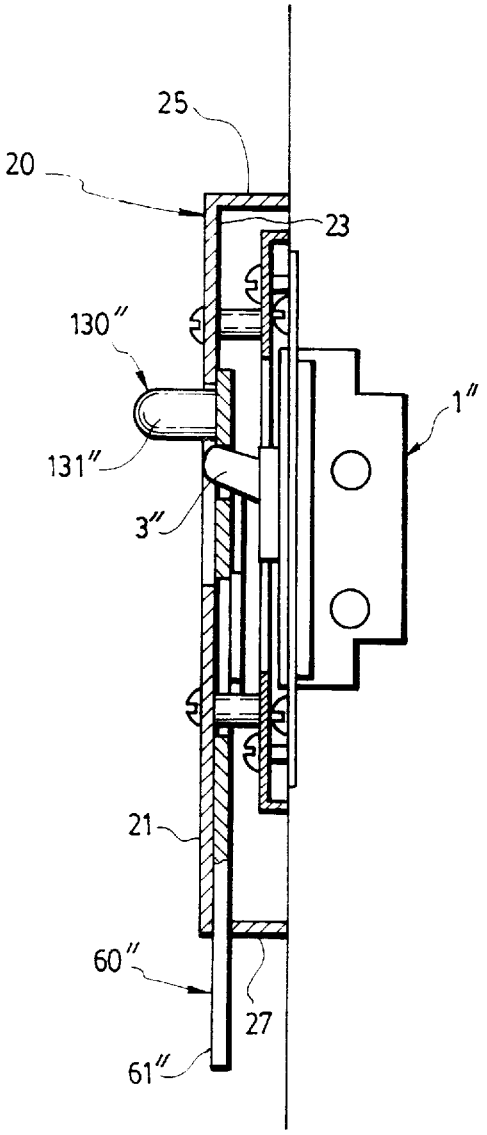
FIG. 7 is a cross-sectional view of the switch extension device shown on FIG. 6 in the "on" position.
Figure 8:
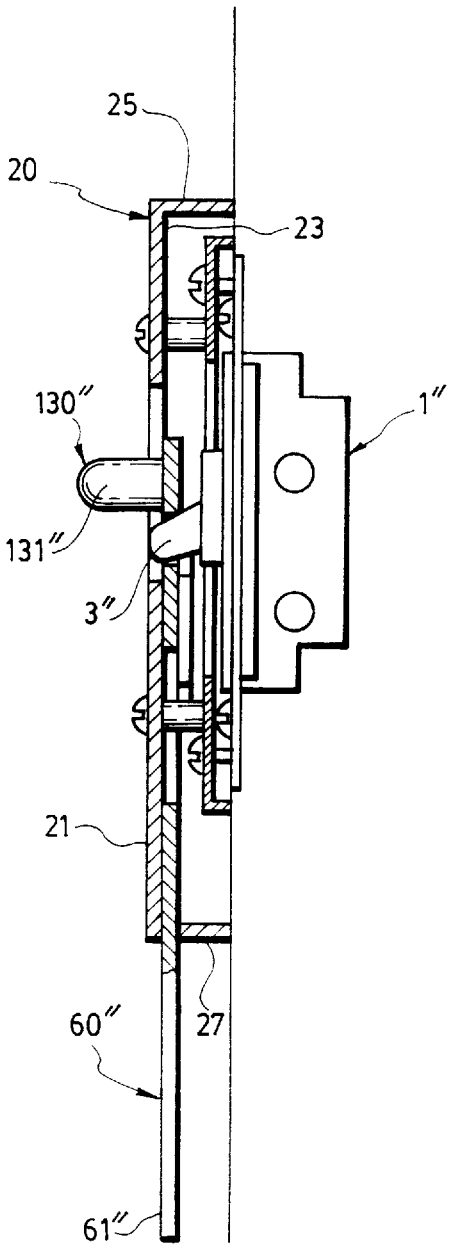
FIG. 8 is a cross-sectional view of the switch extension device shown on FIG. 7 in the "off" position.

The lower part 61" of the slider device 60" protrudes downwardly from the front cover plate 20, as better shown on FIGS. 6, 7 and 8. The lower part 61" of the slider device 60" may extend downwardly to the desired height above floor level, or may further include an extension strip 100 secured thereto. Preferably however, this extension strip 100 is pivotably secured to the lower part 61" of the slider device 60" as shown on FIG. 1, so that the extension strip 100 may pivot about a pivot point 101. This is particularly advantageous when the switch 1" one wants extended is near, for example, a bed, so that a person lying in bed, simply by stretching an arm, may actuate the switch.

In order to actuate the switch 1" manually, i.e. at the height at which the switch 1" is located, the front cover plate 20 has a longitudinal opening 121 for receiving manual actuating means 130". The manual actuating means 130" include a second knob 131" fixed to the upper part 63" of the slider device 60", preferably above the opening 71" as shown on FIG. 6, and projecting on the opposite direction from the actuating member 3" through the longitudinal opening 121. The longitudinal opening 121 preferably has a predetermined length so that the longitudinal opening 121 and the second knob 71" limit the sliding of the slider device 60" at the up and down positions.

Attaching means 80 are also provided for attaching the front cover plate 20 to the fascia plate 5". Preferably, the attaching means 80 include a switch plate 81 having a top 83, a bottom 85 and an aperture 87 positioned and sized to receive the actuating member 3" of the flat rocker-type switch 1". The switch plate 81 is screwed to the fascia plate 5".

Preferably, the switch plate 81 includes a protruding cylinder 89 at each of the top 83 and bottom 85 of the switch plate 81 (see FIG. 6, for example). Thus, the front cover plate 20 is provided with two holes 91 in registered positions with the protruding cylinders 89 of the switch plate 81 and the front cover plate 20 is screwed to the switch plate 81 through these holes 91. In order for the slider device 60" to slide, it is further provided with means for receiving the cylinder 89 at the bottom 85 of the switch plate 81, which in this preferred embodiment is a longitudinal opening 69". Preferably, the longitudinal opening 69" also has a predetermined length to allow the slider device 60" to slide between the up and down positions.

Thus, the switch extension device 10" may be easily installed on a conventional toggle switch 1" easily. Furthermore, the device 10" according to this second preferred embodiment may permit actuation of the switch 1" from a lower height or from the normal height at which the switch 1" is installed.

It can also be seen that the switch extension device can be easily adapted for a flat rocker type switch or for a conventional toggle switch simply by replacing the slider member. However, it is preferable to also replace the switch cover plate in order for the aperture provided in the switch cover plate to adequately cover the switch.

Although the present invention has been explained hereinabove by way of a preferred embodiment thereof, it should be pointed out that any modifications to this preferred embodiment within the scope of the appended claims is not deemed to alter or change the nature and scope of the present invention.

What is claimed is:

1. A switch extension device for actuating a flat rocker-type switch having a pivotable actuating member projecting from a fascia plate, the actuating member having upper and lower rocker portions, the upper and lower portions being in a longitudinal planar relationship to each other, said rocker portions pivoting between upward and downward positions corresponding to "on" and "off" positions of the actuating member, said switch extension device comprising:

a front cover plate having a front surface, a back surface, an upper end and a lower end, the back surface including holding means for receiving in slidable relationship a slider device;

attaching means for securing said front cover plate to the fascia plate;

the slider device having an upper and lower part, the upper part being slidably mounted on the back surface of the front cover plate in said holding means, the lower part of the slider device protruding downwardly from the front cover plate, the upper part of the slider device comprising a first knob projecting towards said actuating member and biasing means for forcing said first knob to constantly exert pressure on said actuating member to make contact therewith, said first knob sliding between up and down positions so that when said knob is at said up position, pressure is exerted on the upper rocker portion and, alternatively, when the knob is at said down position, pressure is exerted on the lower rocker portion so as to actuate said actuating member between said "on" and "off" position through the sliding of said slider member.

2. A switch extension device according to claim 1, wherein:

said slider device has two opposite sides;

the holding means comprise a set of grooves substantially parallel to each other; and each of said opposite sides is slidingly engaged within a respective one of said grooves.

3. A switch extension device according to claim 2, wherein:

said front cover plate has a longitudinal opening for receiving manual actuating means, said manual actuating means being a second knob fixed to the upper part of the slider device and projecting in a direction opposite from said first knob through said longitudinal opening, where said longitudinal opening and said second knob limit said sliding of said first knob at said up and down positions.

4. A switch extension device according to claim 3, wherein said biasing means include a spring.

5. A switch extension device according to claim 4, wherein said device further includes an extension strip secured to the lower part of the slider device.

6. A switch extension device according to claim 5, wherein the extension strip is pivotably secured to the slider device, allowing lateral movement of the extension strip about a pivot point.

7. A switch extension device according to claim 3, wherein:

said attaching means includes a switch plate having a top, a bottom and an aperture positioned and sized to receive the actuating member of the flat rocker-type switch, said switch plate being screwed to said fascia plate and further including a protruding cylinder at each of said top and bottom of said switch plate;

said front cover plate is provided with two holes in registered positions with said protruding cylinders of said switch plate and said front cover plate being screwed to said switch plate through said holes; and the upper part of the slider device is provided with an opening for receiving the lower protruding cylinder at the bottom of the switch plate.

8. A switch extension device according to claim 7, wherein:

said actuating member has a width;

the upper part of said slider device further includes an opening having an upper end, a lower end, a width at least equal to the width of said actuating member, said opening defining a contour, said first and second knob being located on said contour proximate said upper end of said opening, and said means for receiving the lower protruding cylinder at the bottom of the switch plate include a longitudinal recess provided at said lower end of said opening.

9. A switch extension device for a conventional toggle switch, the toggle switch having an actuating member projecting from a fascia plate, the actuating member pivoting between upward and downward positions corresponding to "on" and "off" positions of the actuating member, said switch extension device comprising:

a front cover plate having a front surface and a back surface, an upper end and a lower end, the back surface including holding means for receiving in slidable relationship a slider device;

attaching means for securing said front cover plate to the fascia plate; said attaching means including a switch plate having a top, a bottom and an aperture positioned and sized to receive the actuating member of the conventional toggle switch, said switch plate being screwed to said fascia plate and further including a protruding cylinder at each of said top and bottom of said switch plate;

said front cover plate being further provided with two holes in registered positions with said protruding cylinders of said switch plate and said front cover plate being screwed to said switch plate though said holes;

the slider device having an upper and a lower part, the upper part being slidably mounted on the back surface of the front cover plate in said holding means, the lower part of the slider device protruding downwardly from the front cover plate, the upper part of the slider device comprising an opening shaped and sized to engage said actuating member, said slider device sliding between up and down positions so that when said slider device is at said up position, said opening toggles the actuating member to the "on" position and, alternatively, when said slider device is at said down position, said opening toggles the actuating member to the "off" position; the upper part of the slider device further including a longitudinal opening for receiving the protruding cylinder at the bottom of the switch plate, said longitudinal opening having a predetermined length to allow said slider device to slide between said up and down positions; and an extension strip secured to the lower part of the slider device.

10. A switch extension device according to claim 9, wherein:

said slider device has two opposite sides;

the holding means comprise a set of grooves substantially parallel to each other; and each of said opposite sides is slidingly engaged within a respective one of said grooves.

11. A switch extension device according to claim 10, wherein:

said front cover plate has a longitudinal opening for receiving manual actuating means, said manual actuating means being a knob fixed to the upper part of the slider device and projecting through said longitudinal opening, where said longitudinal opening and said knob limit said sliding of slider device at said up and down positions.

12. A switch extension device according to claim 11, wherein said extension strip is pivotably secured to the slider device, allowing lateral movement of the extension strip about a pivot point.

13. A switch extension device for actuating a switch having an actuating member protecting from a fascia plate, the actuating member having upward and downward positions corresponding to "on" and "off" positions of the actuating member, said switch extension device comprising:

a front cover plate having a front surface, a back surface, an upper end and a lower end, the back surface including holding means for receiving in slidable relationship a slider device;

attaching means for securing said front cover plate to the fascia plate; said attaching means including a switch plate having a top, a bottom and a aperture positioned and sized to receive the actuating member of the switch, said switch plate being screwed to said fascia plate and further including a protruding cylinder at each of said top and bottom of said switch plate;

said front cover plate being further provided with two holes in registered positions with said protruding cylinders of said switch plate and said front cover plate being screwed to said switch plate through said holes;

the slider device having an upper and lower part, the upper part being slidably mounted on the back surface of the front cover plate in said holding means, the lower part of the slider a device protruding downwardly from the front cover plate, the slider device including means for actuating said actuating member, said slider device sliding between up and down positions so that when said slider device is at said up position, said slider device actuates said actuating member to said "on" position and, alternatively, when said slider device is at said down position, said slider device actuates said actuating member to said "off" position, said slider device including means for receiving the protruding cylinder at the bottom of the switch plate so as to allow said slider device to slide between said up and down positions.

14. A switch extension device according to claim 13, wherein:

said slider device has two opposite sides;

the holding means comprise a set of grooves substantially parallel to each other; and each of said opposite sides is slidingly engaged within a respective one of said grooves.

15. A switch extension device according to claim 14, wherein:

said front cover plate has a longitudinal opening for receiving manual actuating means, said manual actuating means being a knob fixed to the upper part of the slider device and projecting through said longitudinal opening, where said longitudinal opening and said knob limit said sliding of said slider device at said up and down positions.

16. A switch extension device according to claim 15, wherein said device further includes an extension strip secured to the lower part of the slider device.

17. A switch extension device according to claim 16, wherein the extension strip is pivotably secured to the slider device, allowing lateral movement of the extension strip about a pivot point.

* * * * *